US010734171B2

(12) United States Patent
Huo

(10) Patent No.: US 10,734,171 B2
(45) Date of Patent: Aug. 4, 2020

(54) LOCK ASSEMBLIES FOR SWITCH DEVICES OF ELECTRICAL POWER DISTRIBUTION SYSTEMS

(71) Applicant: ABB Schweiz AG, Baden (CH)

(72) Inventor: Bin Huo, Shanghai (CN)

(73) Assignee: ABB Schweiz AG, Baden (CH)

( * ) Notice: Subject to any disclaimer, the term of this patent is extended or adjusted under 35 U.S.C. 154(b) by 74 days.

(21) Appl. No.: 15/985,192

(22) Filed: May 21, 2018

(65) Prior Publication Data

US 2019/0019635 A1 Jan. 17, 2019

(30) Foreign Application Priority Data

Jul. 14, 2017 (CN) ..... 2017 1 0574139

(51) Int. Cl.
*H01H 9/28* (2006.01)

(52) U.S. Cl.
CPC ..... *H01H 9/285* (2013.01); *H01H 9/282* (2013.01); *H01H 9/283* (2013.01)

(58) Field of Classification Search
CPC ..... H01H 9/285; H01H 9/283
USPC ..... 200/43.11
See application file for complete search history.

(56) References Cited

U.S. PATENT DOCUMENTS

2009/0152079 A1* 6/2009 Hauke ..... H01H 9/24 200/50.21
2013/0001953 A1* 1/2013 Brignoli ..... H01H 9/167 290/55

FOREIGN PATENT DOCUMENTS

CN 103441439 * 12/2013 ..... H02B 11/133
CN 103441439 A 12/2013
DE 102006024007 A1 11/2007

* cited by examiner

*Primary Examiner* — Edwin A. Leon
*Assistant Examiner* — Iman Malakooti
(74) *Attorney, Agent, or Firm* — Barnes & Thornburg LLP

(57) ABSTRACT

A lock assembly for a switch device of an electrical power distribution system includes a first lock and a second lock. The lock assembly also includes a connector arranged to inhibit movement of the first lock when the switch device is in a first position and inhibit movement of the second lock when the switch device is in a second position. The lock assembly further includes a guard coupled to at least one of the first lock and the second lock. The guard is positionable between a first position in which the guard allows access to an actuating mechanism of the switch device and a second position in which the guard inhibits access to the actuating mechanism. The guard is moveable between the first position and the second position when at least one of said first lock and said second lock is rotated.

20 Claims, 6 Drawing Sheets

LOCK ASSEMBLIES FOR SWITCH DEVICES OF ELECTRICAL POWER DISTRIBUTION SYSTEMS

BACKGROUND

The present application relates generally to electrical power distribution systems and, more particularly, to lock assemblies for switch devices of electrical power distribution systems.

At least some known electrical power distribution systems include a plurality of switchgear lineups including circuit breakers that are coupled to one or more loads. The circuit breakers are configured to interrupt current to the loads if the current is outside of acceptable conditions.

At least some known electrical power distribution systems include switch devices to protect operators from the current flowing through the electrical power distribution systems. For example, at least some known switch devices are configured to selectively isolate the circuit breakers and allow operators to safely access and/or remove circuit breakers. The switch devices are positionable between an opened position and a closed position. At least some known switch devices include separate locks for the opened position and the closed position. However, it may not be readily apparent to an operator if the switch device is in the opened position or the closed position. As a result, the operator may attempt to operate the incorrect lock for the position of the switch device and/or attempt to override the position of the switch device.

BRIEF DESCRIPTION

In one aspect, an electrical power distribution system is provided. The electrical power distribution system includes a circuit protection device arranged to interrupt current flowing through a circuit and a switch device coupled to the circuit protection device. The switch device is positionable between a first position and a second position. The switch device includes an actuating mechanism. The electrical power distribution system also includes a lock assembly coupled to the switch device. The lock assembly includes a first lock arranged to rotate about a first axis and a second lock arranged to rotate about a second axis. The lock assembly also includes a connector coupled to the switch device. The connector extends from the switch device to the first lock and the second lock. The connector is arranged to prevent rotation of the first lock when the switch device is in the first position. The connector is arranged to prevent rotation of the second lock when the switch device is in the second position. The electrical power distribution system further includes a guard coupled to at least one of the first lock and the second lock. The guard is positionable between a first position in which the guard allows access to the actuating mechanism and a second position in which the guard inhibits access to the actuating mechanism. The guard is moveable between the first position and the second position when at least one of the first lock and the second lock is rotated.

In another aspect, a lock assembly for a switch device of an electrical power distribution system is provided. The lock assembly includes a first lock and a second lock. The lock assembly also includes a connector coupled to the first lock and the second lock. The connector is arranged to inhibit movement of the first lock when the switch device is in a first position. The connector is arranged to inhibit movement of the second lock when the switch device is in a second position. The lock assembly further includes a guard coupled to at least one of the first lock and the second lock. The guard is positionable between a first position in which the guard allows access to an actuating mechanism of the switch device and a second position in which the guard inhibits access to the actuating mechanism. The guard is moveable between the first position and the second position when at least one of said first lock and said second lock is rotated.

Although specific features of various embodiments may be shown in some drawings and not in others, this is for convenience only. Any feature of any drawing may be referenced and/or claimed in combination with any feature of any other drawing.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Exemplary embodiments of electrical power distribution systems and methods of operating electrical power distribution systems are described herein. The exemplary electrical power distribution systems include a switch device and a lock assembly for the switch device. The lock assembly includes locks that are coupled to a connector. The connector provides mutually exclusive operation of the locks. In addition, the lock assembly includes a guard that restricts access to the switch device. In some embodiments, the guard is coupled to the locks such that movement of at least one of the locks causes the guard to move between a first position and a second position.

Figure 1:
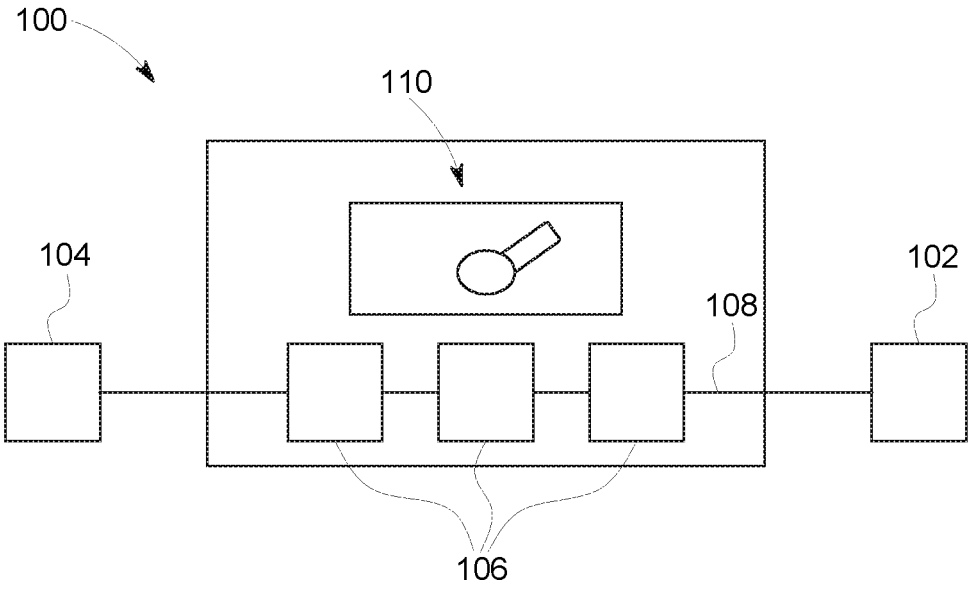
FIG. 1 is a schematic block diagram of an exemplary electrical power distribution system.

FIG. 1 is a schematic block diagram of a portion of an exemplary electrical power distribution system 100 including at least one source 102 providing power to at least one load 104 via circuit protection devices 106. Electrical power sources 102 may include, for example, one or more generators, electrical grids, or other devices that provide electrical current (and resulting electrical power) to loads 104. The electrical current may be transmitted to load 104 through distribution busses 108. Loads 104 may include, but are not limited to only including, machinery, motors, lighting, and/or other electrical and mechanical equipment of a manufacturing or power generation or distribution facility. Although connections between components in system 100 are illustrated with a single line for simplicity, it should be understood that system 100 will include multiple electrical connections between components, such as a line connection, a neutral connection, and a ground connection. Moreover, some embodiments are multiphase systems including a separate line connection for each phase of electricity.

In some embodiments, circuit protection devices 106 are housed in one or more switchgear units (not shown in FIG. 1). The switchgear units include racks to which circuit protection devices 106 are mounted within a cabinet. Circuit protection devices 106 that are electrically close to each other may be disposed physically close to each other, such as in the same switchgear unit, or physically distant from each other, such as in separate switchgear units, in separate rooms, etc. Similarly, circuit protection devices 106 that are electrically distant from each other may be disposed physically close to each other or physically distant from each other.

In the exemplary embodiment, electrical power distribution system 100 includes at least one switch device 110. In the exemplary embodiment, switch device 110 is an earthing switch which is configured to provide grounding and isolation for circuit protection devices 106. Switch device 110 is positionable between an opened position, broadly a first position, and a closed position, broadly a second position. In the first position, switch device 110 allows current to flow through circuit protection devices 106. In the second position, switch device 110 isolates at least one circuit protection device 106 and inhibits current flowing to the isolated circuit protection device 106. Accordingly, switch device 110 is configured to reduce the risk of electrical shock when operators access portions of electrical power distribution system 100. For example, in some embodiments, switch device 110 is moveable between the first position and the second position when at least one circuit protection device 106 is removed from electrical power distribution system 100. In alternative embodiments, electrical power distribution system 100 includes any switch device 110 that enables electrical power distribution system 100 to operate as described herein.

In the exemplary embodiment, circuit protection devices 106 include circuit breakers configured to trip and interrupt the flow of current through circuits coupled to circuit protection devices 106. In alternative embodiments, electrical power distribution system 100 includes any circuit protection device 106 that enables electrical power distribution system 100 to operate as described herein. For example, in some embodiments, circuit protection device 106 includes, for example and without limitation, one or more other circuit breaker devices and/or arc containment devices. Exemplary circuit breaker devices include, for example and without limitation, circuit switches, contact arms, and/or circuit interrupters that interrupt current flowing through the circuit breaker device to a load 104 coupled to the circuit breaker device. An exemplary arc containment device includes, for example and without limitation, a containment assembly, a plurality of electrodes, a plasma gun, and a trigger circuit that causes the plasma gun to emit ablative plasma into a gap between the electrodes in order to divert energy into the containment assembly from an arc or other electrical fault that is detected on the circuit.

Figure 2:
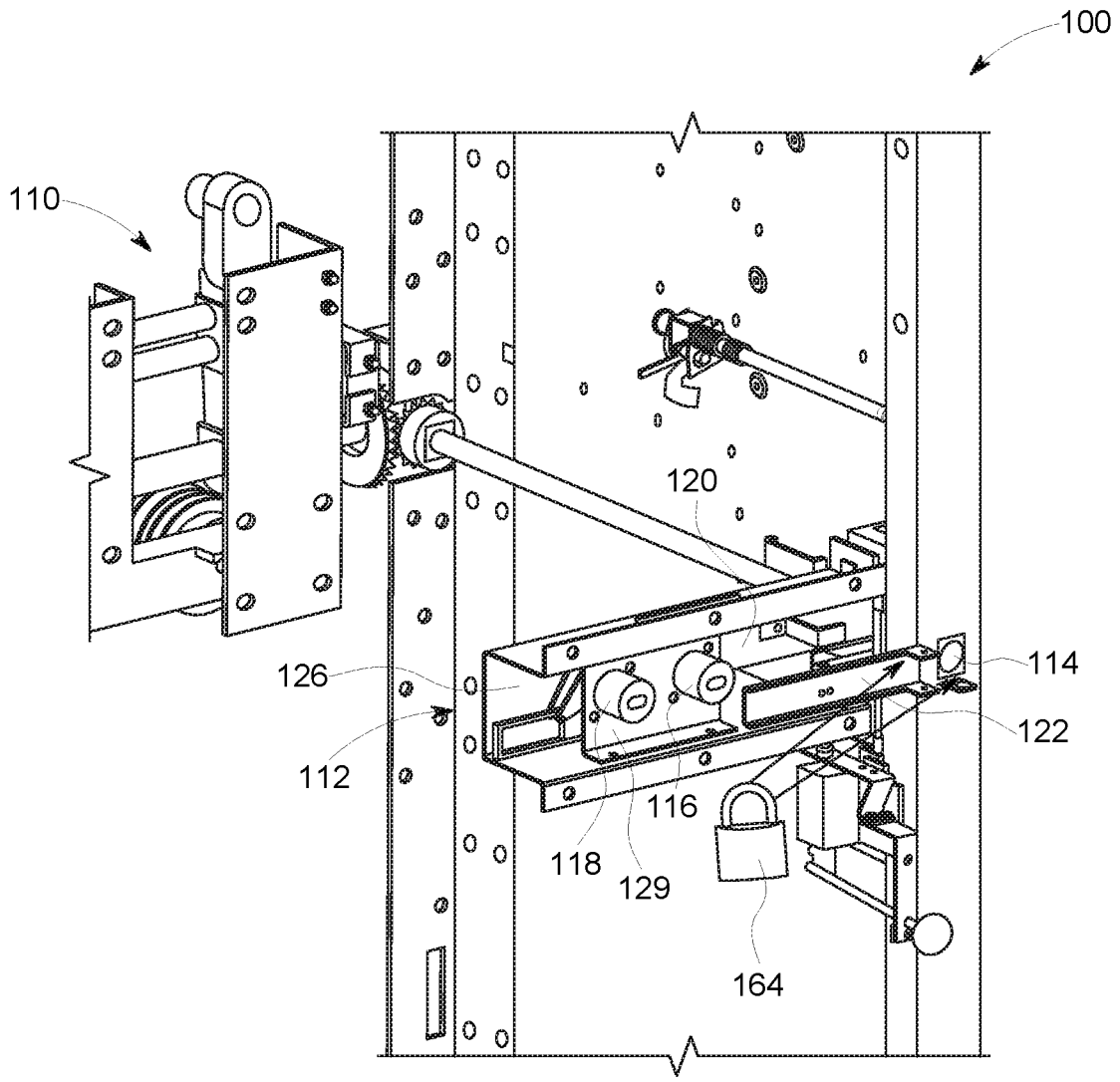
FIG. 2 is a perspective view of a portion of the electrical power distribution system shown in FIG. 1.
Figure 3:
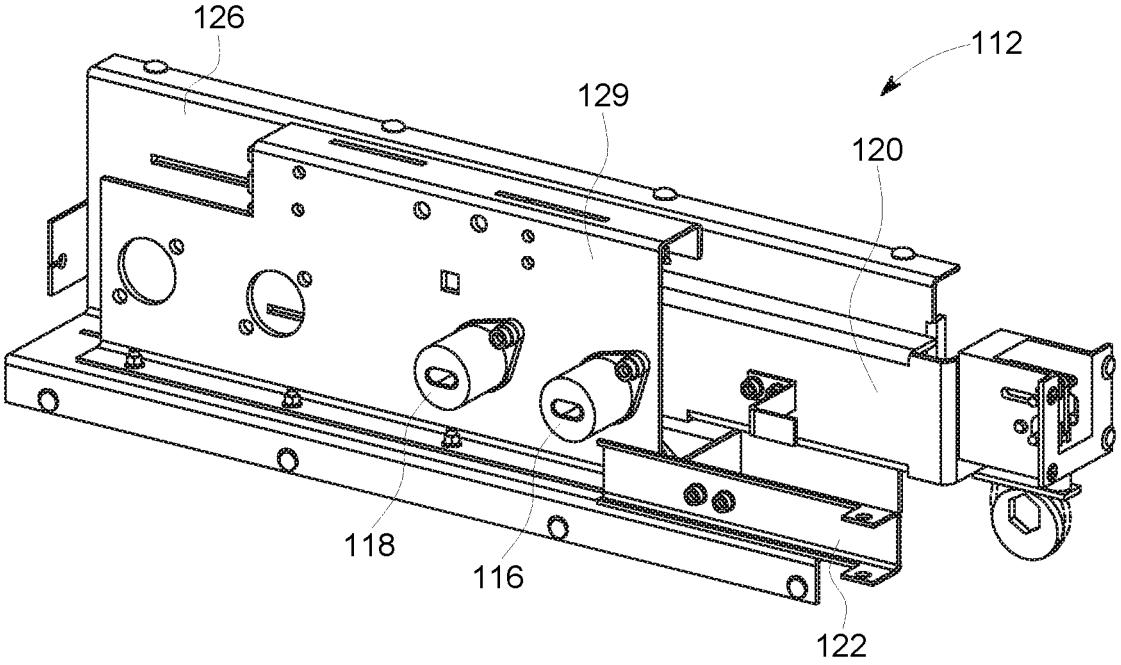
FIG. 3 is a front perspective view of a lock assembly of the electrical power distribution system shown in FIGS. 1 and 2.
Figure 4:
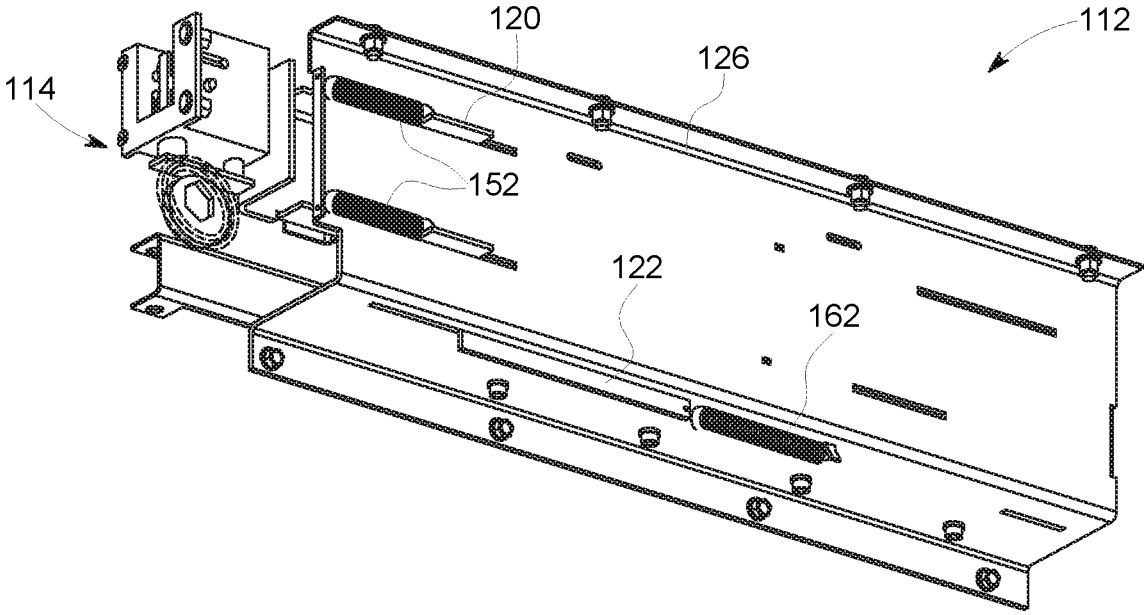
FIG. 4 is a rear perspective view of the lock assembly.

FIG. 2 is a perspective view of a portion of electrical power distribution system 100. FIG. 3 is a front perspective view of a lock assembly 112 of electrical power distribution system 100. FIG. 4 is a rear perspective view of lock assembly 112. Lock assembly 112 is coupled to switch device 110. Switch device 110 includes an actuating mechanism 114 and is positionable between an opened position and a closed position. Lock assembly 112 is configured to restrict movement of switch device 110 between the opened position and the closed position. In addition, lock assembly 112 restricts access to actuating mechanism 114. Accordingly, lock assembly 112 prevents improper operation of switch device 110 and prevents current flowing through portions of electrical power distribution system 100 when an operator accesses electrical power distribution system 100. In alternative embodiments, switch device 110 and lock assembly 112 have any configuration that enables electrical power distribution system 100 to operate as described herein.

Figure 5:
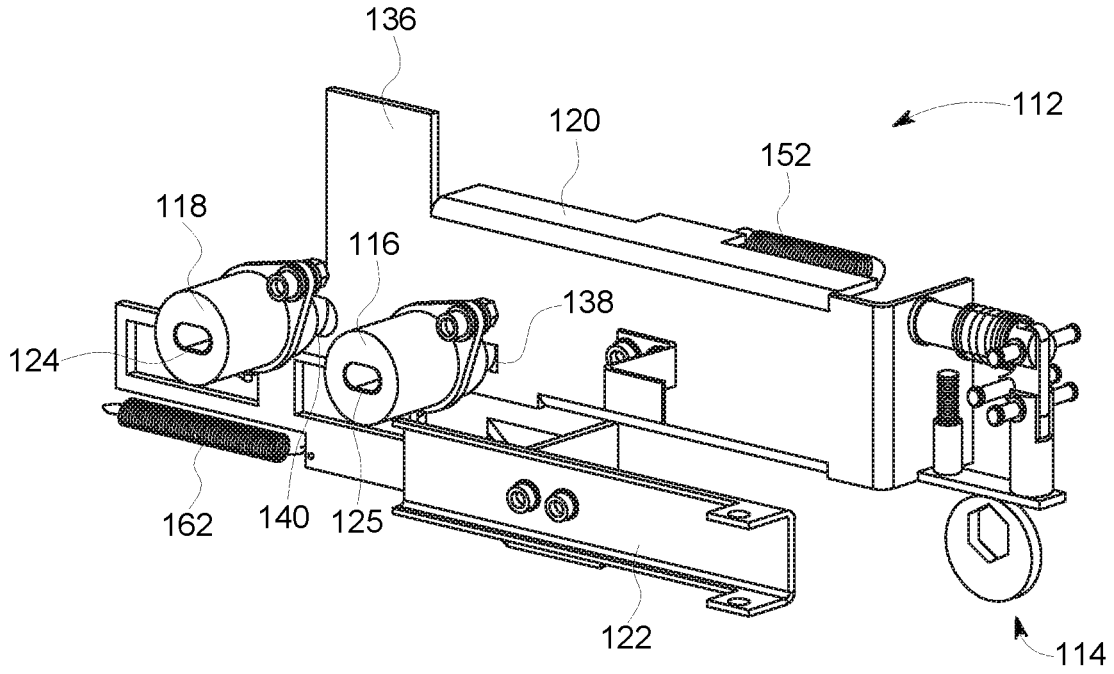
FIG. 5 is a front perspective view of a portion of the lock assembly.
Figure 6:
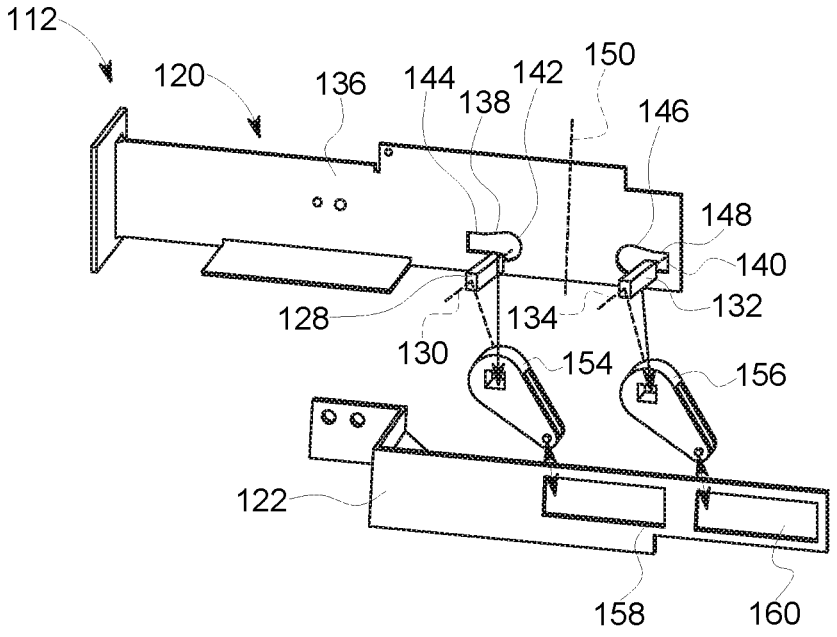
FIG. 6 is an exploded view of a portion of the lock assembly.

FIG. 5 is a front perspective view of a portion of lock assembly 112. FIG. 6 is an exploded view of a portion of lock assembly 112. Lock assembly 112 includes a first lock 116, a second lock 118, a connector 120, and a guard 122. First lock 116 defines a first keyhole or opening 124 configured to receive a key or tool (not shown) for operating first lock 116. Second lock 118 defines a second keyhole or opening 125 configured to receive a key or tool (not shown) for operating second lock 118. In the exemplary embodiment, first lock 116 and second lock 118 are positionable between an unlocked position and a locked position. In alternative embodiments, lock assembly 112 includes any lock that enables lock assembly 112 to operate as described herein.

In addition, in the exemplary embodiment, lock assembly 112 includes a bracket 126 and a plate 129. First lock 116 and second lock 118 are coupled to plate 129. Plate 129, connector 120, and guard 122 are coupled to bracket 126 such that bracket 126 supports plate 129, connector 120, and guard 122. Connector 120 and guard 122 are arranged to move relative to bracket 126. Bracket 126 is used to mount lock assembly 112 within electrical power distribution system 100. In alternative embodiments, lock assembly 112 is supported and/or mounted to electrical power distribution system 100 in any manner that enables electrical power distribution system 100 to operate as described herein.

Also, in the exemplary embodiment, first lock 116 is coupled to a first shaft 128. First lock 116 and first shaft 128 are configured to rotate about an axis 130 through first shaft 128. Second lock 118 is coupled to a second shaft 132. Second lock 118 and second shaft 132 are configured to rotate about an axis 134 through second shaft 132. Axis 134 of second shaft 132 is parallel to and spaced from axis 130 of first shaft 128. In the exemplary embodiment, at least a portion of first shaft 128 and second shaft 132 are rectangular cuboids and are configured to engage connector 120. First shaft 128 and second shaft extend through openings in plate 129. In alternative embodiments, lock assembly 112 includes any first shaft 128 and/or second shaft 132 that enables lock assembly 112 to operate as described herein. For example, in some embodiments, first shaft 128 and second shaft 132 include cylindrical portions.

To operate lock assembly 112, an operator positions a key or tool (not shown) into keyhole 124 of first lock 116 or keyhole 125 of second lock 118 and rotates the key to move first lock 116 or second lock 118 between the unlocked position and the locked position. In alternative embodiments, first lock 116 and second lock 118 have any configuration that enables lock assembly 112 to operate as described herein. For example, in some embodiments, first lock 116 and/or second lock 118 include a component configured to move linearly and do not necessarily rotate.

In addition, in the exemplary embodiment, connector 120 is coupled to switch device 110 (shown in FIG. 2) and extends from switch device 110 to first lock 116 and second lock 118. Connector 120 includes a body 136 defining a first opening 138 configured to receive first shaft 128 and a second opening 140 configured to receive second shaft 132. Accordingly, connector 120 couples first lock 116 and second lock 118 to switch device 110. In alternative embodiments, connector 120 is coupled to any component that enables lock assembly 112 to operate as described herein.

In the exemplary embodiment, first opening 138 of connector 120 includes a first portion 142 and a second portion 144. First portion 142 is defined by a curved edge and is circular. In addition, first portion 142 is larger than first shaft 128. Accordingly, first portion 142 of first opening 138 allows first shaft 128 to rotate relative to connector 120. Second portion 144 is shaped to prevent rotation of first shaft 128. Second portion 144 is defined by linear edges and has a rectangular shape. Moreover, a width of second portion 144 is less than the diagonal of the rectangular portion of first shaft 128. Accordingly, second portion 144 inhibits first shaft 128 rotating relative to connector 120.

In addition, in the exemplary embodiment, second opening 140 of connector 120 includes a first portion 146 and a second portion 148. First portion 146 is shaped to allow rotation of second shaft 132. In particular, first portion 146 is defined by a curved edge and is circular. In addition, first portion 146 is larger than second shaft 132. Accordingly, first portion 146 of second opening 140 allows second shaft 132 to rotate relative to connector 120 when second shaft 132 is positioned in first portion 146. Second portion 148 is shaped to prevent rotation of second shaft 132. Second portion 148 is defined by linear edges and has a rectangular shape. Moreover, a width of second portion 148 is less than the diagonal of the rectangular portion of second shaft 132. Accordingly, second portion 148 of second opening 140 inhibits second shaft 132 rotating relative to connector 120. In alternative embodiments, connector 120 includes any opening that enables lock assembly 112 to operate as described herein.

In addition, in the exemplary embodiment, second opening 140 is a mirror image of first opening 138 about an axis 150 extending between first opening 138 and second opening 140. In alternative embodiments, first opening 138 and second opening 140 have any configuration that enables lock assembly 112 to operate as described herein. For example, in some embodiments, first opening 138 is elongated in a first direction and second opening 140 is elongated in a second direction different from the first direction. In further embodiments, first opening 138 and second opening 140 have different shapes.

Figure 7:
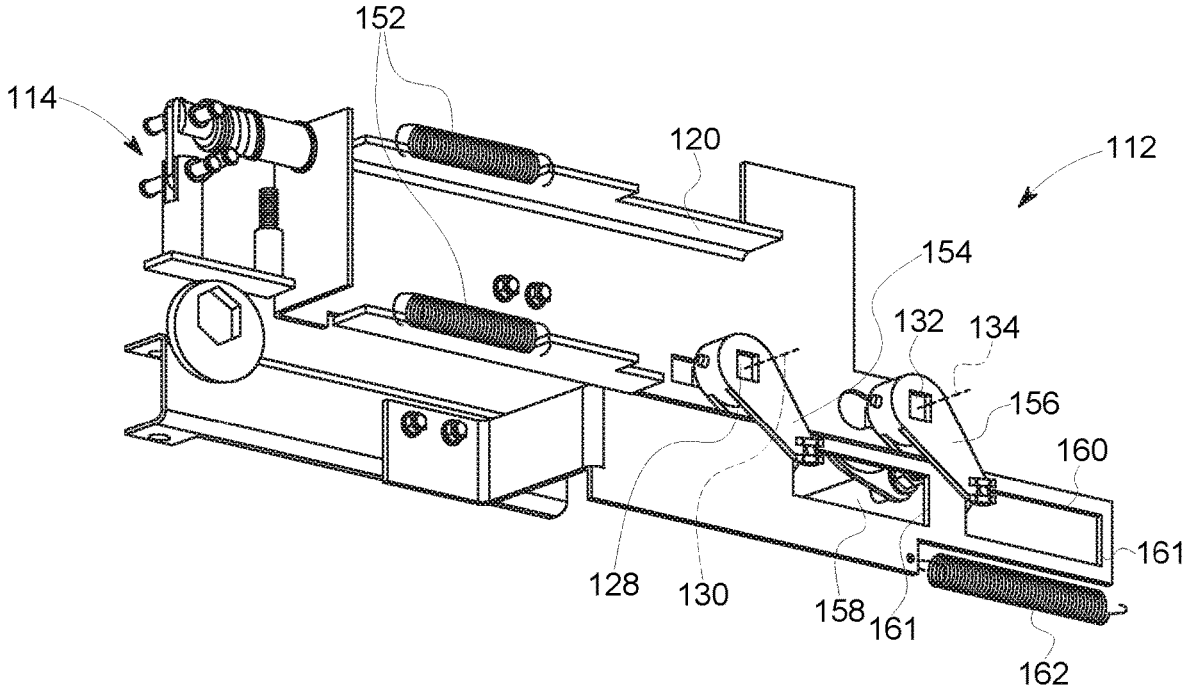
FIG. 7 is a rear perspective view of a portion of the lock assembly.
Figure 8:
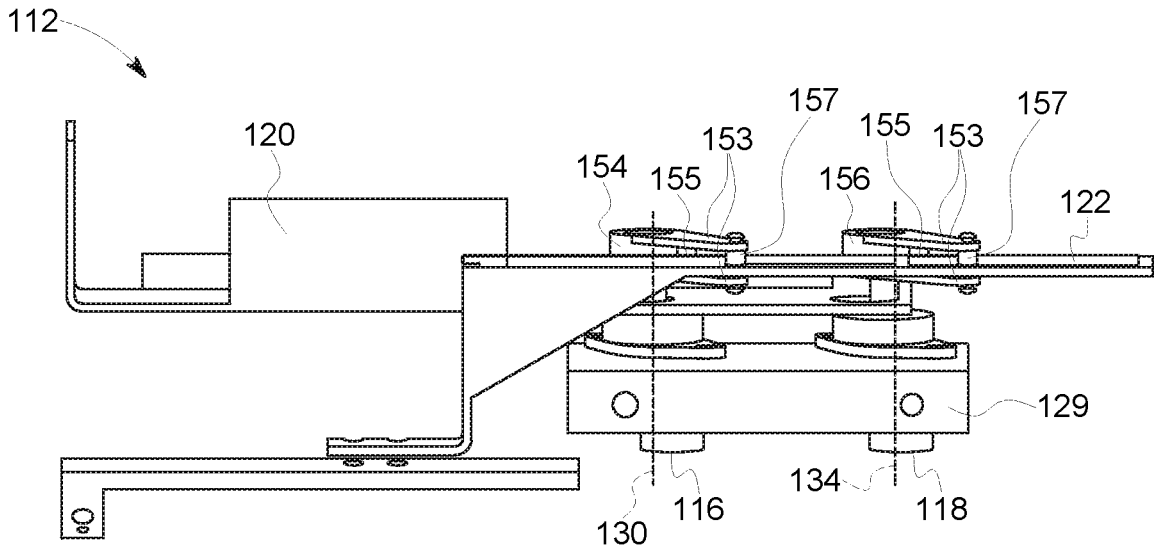
FIG. 8 is a top view of a portion of the lock assembly.

FIG. 7 is a rear perspective view of a portion of lock assembly 112. FIG. 8 is a top view of a portion of lock assembly 112. In the exemplary embodiment, connector 120 of lock assembly 112 is positionable between a first position and a second position. During operation of lock assembly 112, in the exemplary embodiment, connector 120 moves linearly between the first position and the second position. When connector 120 is in the first position, first shaft 128 is received in first portion 142 of first opening 138 and second shaft 132 is received in first portion 146 of second opening 140. When connector 120 is in the second position, first shaft 128 is received in the second portion 144 of first opening 138 and second shaft 132 is received in second portion 148 of second opening 140. Accordingly, connector 120 provides mutually exclusive operation of first lock 116 and second lock 118. For example, first lock 116 is allowed to move and second lock 118 is inhibited from moving when connector 120 is in the first position. When connector 120 is moved to the second position, second lock 118 is allowed to move and first lock 116 is inhibited from moving. In alternative embodiments, connector 120 has any position that enables lock assembly 112 to operate as described herein.

Moreover, in the exemplary embodiment, at least one biasing member 152 is coupled to connector 120 and biases connector 120 towards the first position. Accordingly, connector 120 remains in the first position until a force acts on connector 120 and overcomes the biasing force of biasing member 152. In some embodiments, actuating mechanism 114 is configured to move connector 120 from the first position to the second position when switch device 110 (shown in FIG. 2) is moved to the opened position. In the exemplary embodiment, lock assembly 112 includes two springs that act as biasing members 152 for connector 120. In alternative embodiments, lock assembly 112 includes any biasing member 152 that enables lock assembly 112 to operate as described herein.

In addition, in the exemplary embodiment, guard 122 is coupled to first lock 116 by a first link 154. Guard 122 is coupled to second lock by a second link 156. Guard 122 extends from first lock 116 and second lock 118 towards actuating mechanism 114. Guard 122 is positionable between a first position in which guard 122 allows access to actuating mechanism 114 and a second position in which guard 122 inhibits access to actuating mechanism 114. In the exemplary embodiment, guard 122 is arranged to move between the first position and the second position when at least one of first lock 116 and second lock 118 is moved between the unlocked position and the locked position. In alternative embodiments, guard 122 is positionable in any manner that enables guard 122 to function as described herein.

Also, in the exemplary embodiment, guard 122 includes an L-shaped member and an arm connected to the L-shaped member. The configuration of guard 122 facilitates guard 122 coupling to first lock 116 and second lock 118 and allows guard 122 to extend across actuating mechanism 114. In alternative embodiments, lock assembly 112 includes any guard 122 that enables lock assembly 112 to operate as described herein.

Also, in the exemplary embodiment, guard 122 includes a first opening 158 and a second opening 160. First opening 158 is arranged to receive first link 154. Second opening 160 is arranged to receive second link 156. In the exemplary embodiments, each of first link 154 and second link 156 includes a pair of arms 153 defining a gap 155. Accordingly, first link 154 and second link 156 are yoke-shaped. Gap 155 is sized to receive a portion of guard 122. Pins 157 extend across gaps 155 between respective arms 153 to engage guard 122. First link 154 and second link 156 are arranged to engage guard 122 such that rotational movement of first lock 116 or second lock 118 is translated by arms 153 into linear movement of guard 122. Accordingly, first lock 116 and second lock 118 move guard 122 between the first position and the second position. Specifically, first link 154 and second link 156 contact edges 161 of guard 122 and cause guard 122 to move between the first position and the second position when first link 154 and/or second link 156 is displaced by movement of first lock 116 and/or second lock 118. A biasing member 162 is coupled to guard 122 and biases guard 122 towards the first position and towards first link 154 and second link 156. In alternative embodiments, guard 122, first lock 116, and/or second lock 118 are coupled in any manner that enables lock assembly 112 to operate as described herein. For example, in some embodiments, first link 154 and/or second link 156 is omitted and guard 122 directly engages first lock 116, second lock 118, first shaft 128, and/or second shaft 132.

In addition, in the exemplary embodiment, lock assembly 112 is configured to allow movement of guard 122 relative to first link 154 and second link 156. For example, guard 122 may be manually moved between the first position and the second position while first lock 116 and second lock 118 remain stationary. In the exemplary embodiment, first opening 158 and second opening 160 are rectangular slots and are sized to allow movement of guard 122 relative to first link 154 and second link 156. In alternative embodiments, guard 122 is positionable in any manner that enables lock assembly 112 to operate as described herein.

In addition, in the exemplary embodiment, guard 122 is arranged to receive a padlock 164 (shown in FIG. 2). As a result, guard 122 may be coupled in at least one of the first position and the second position. In the exemplary embodiment, padlock 164 is configured to maintain guard 122 in the second position. Specifically, padlock 164 couples guard 122 to a portion of electrical power distribution system 100 adjacent actuating mechanism 114 and prevents access to actuating mechanism 114. In alternative embodiments, guard 122 is secured in position in any manner that enables electrical power distribution system 100 to operate as described herein. For example, in some embodiments, guard 122 is removably coupled to a portion of electrical power distribution system 100 by an attachment device including, for example and without limitation, a fastener, a clip, an adhesive, a hook, and any other suitable attachment device.

Embodiments of the electrical power distribution systems described above include a switch device and a lock assembly for the switch device. The lock assembly includes locks that are coupled to a connector. The connector provides mutually exclusive operation of the locks. In addition, the lock assembly includes a guard that restricts access to the switch device. In some embodiments, the guard is coupled to the locks such that movement of at least one of the locks causes the guard to move between a first position and a second position.

An exemplary technical effect of the methods, systems, and apparatus described herein includes at least one of: (a) restricting access to a switch device of an electrical power distribution system when a lock assembly is in a locked position; (b) preventing operators from overriding a lock assembly of an electrical power distribution system; (c) providing locks that are connected by a connector that allows mutually exclusive operation of the locks; (d) providing an indication to an operator of a position of a switch device; and (e) enabling the isolation of circuit protection devices of an electrical power distribution system to allow safe access to the electrical power distribution system.

Exemplary embodiments of electrical power distribution systems are described above in detail. The electrical power distribution systems are not limited to the specific embodiments described herein but, rather, components of the electrical power distribution systems and operations may be utilized independently and separately from other components and/or operations described herein. Further, the described components and/or operations may also be defined in, or used in combination with, other systems, methods, and/or devices, and are not limited to practice with only the electrical power distribution systems and apparatuses described herein.

The order of execution or performance of the operations in the embodiments of the disclosure illustrated and described herein is not essential, unless otherwise specified. That is, the operations may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrical power distribution system comprising:

a circuit protection device arranged to interrupt current flowing through a circuit;

a switch device coupled to said circuit protection device, wherein said switch device is positionable between a first position and a second position, said switch device including an actuating mechanism; and a lock assembly coupled to said switch device, said lock assembly comprising:

a first lock arranged to rotate about a first axis;

a second lock arranged to rotate about a second axis;

a connector coupled to said switch device, said connector extending from said switch device and engaged with each of said first lock and said second lock, wherein, when said switch device is in the first position, said connector is arranged in a first connector position preventing rotation of said first lock and permitting rotation of the second lock, and wherein, when said switch device is in the second position, said connector is arranged in a second connector position preventing rotation of said second lock; and a guard coupled to at least one of said first lock and said second lock, wherein said guard is positionable between a first position in which said guard allows access to said actuating mechanism and a second position in which said guard inhibits access to said actuating mechanism, and wherein said guard is moveable between the first position and the second position when at least one of said first lock and said second lock is rotated.

2. The electrical power distribution system in accordance with claim 1, wherein said first lock is coupled to a first shaft, and wherein said second lock is coupled to a second shaft.

3. The electrical power distribution system in accordance with claim 2, wherein said connector includes a body defining a first opening arranged to receive said first shaft, said first opening including a first portion shaped to allow rotation of said first shaft and a second portion shaped to prevent rotation of said first shaft.

4. The electrical power distribution system in accordance with claim 3, wherein said first shaft includes a cuboid portion.

5. The electrical power distribution system in accordance with claim 4, wherein said first portion is defined by a curved edge and said second portion is defined by a linear edge.

6. The electrical power distribution system in accordance with claim 3, wherein said body further defines a second opening arranged to receive said second shaft, said second opening including a first portion shaped to allow rotation of said second shaft and a second portion shaped to prevent rotation of said second shaft.

7. The electrical power distribution system in accordance with claim 6, wherein an axis extends between the first opening and the second opening, and wherein the first opening and the second opening are mirror images of one another about the axis.

8. The electrical power distribution system in accordance with claim 6, wherein said connector is positionable between i) a first position in which said first shaft is received in the first portion and said second shaft is received in the second portion, and ii) a second position in which said first shaft is received in the second portion and said second shaft is received in the first portion.

9. The electrical power distribution system in accordance with claim 8, wherein said lock assembly further comprises a biasing member to bias said connector towards the first position.

10. The electrical power distribution system in accordance with claim 8, wherein said connector is arranged to move between the connector first position and the connector second position when said switch device moves between the switch device first position and the switch device second position.

11. The electrical power distribution system in accordance with claim 1, wherein said guard defines a first opening arranged to receive a first link coupled to said first lock and a second opening arranged to receive a second link coupled to said second lock, said first lock and said second lock arranged to move said guard between the first position and the second position.

12. The electrical power distribution system in accordance with claim 11, wherein said first opening and said second opening are sized to allow said guard to move relative to said first lock and said second lock between the first position and the second position.

13. The electrical power distribution system in accordance with claim 1, wherein said lock assembly further comprises a biasing member to bias said guard towards the first position.

14. The electrical power distribution system in accordance with claim 1, wherein said guard is arranged to receive a padlock in the second position that secures said guard in the second position.

15. A lock assembly for a switch device of an electrical power distribution system, said lock assembly comprising:

a first lock;

a second lock;

a connector extending between and engaged with each of said first lock and said second lock, wherein said connector can be arranged in a first position to inhibit movement of said first lock and to permit movement of said second lock when the switch device is in a first position, and wherein said connector can be arranged in a second position to inhibit movement of said second lock and to permit movement of said first lock when said switch device is in a second position; and a guard coupled to at least one of said first lock and said second lock, wherein said guard is positionable between a first position in which said guard allows access to an actuating mechanism of the switch device and a second position in which said guard inhibits access to the actuating mechanism, and wherein said guard is moveable between the first position and the second position when at least one of said first lock and said second lock is moved.

16. The lock assembly in accordance with claim 15, wherein said first lock is coupled to a first shaft and is arranged to rotate about a first axis, and wherein said second lock is coupled to a second shaft and is arranged to rotate about a second axis.

17. The lock assembly in accordance with claim 16, wherein said connector includes a body defining a first opening arranged to receive said first shaft, said first opening including a first portion shaped to allow rotation of said first shaft and a second portion shaped to prevent rotation of said first shaft.

18. The lock assembly in accordance with claim 15, further comprising a first link and a second link, wherein said first link couples said first lock to said guard and said second link couples said second lock to said guard, and wherein said first lock and second lock are arranged to move said guard between the first position and the second position.

19. The lock assembly in accordance with claim 18, wherein said guard defines a first opening arranged to receive said first link and a second opening arranged to receive said second link.

20. The lock assembly in accordance with claim 19, wherein the first opening and the second opening are sized to allow said guard to move relative to said first lock and said second lock between the first position and the second position.

* * * * *